United States Patent [19]

De Filippis

[11] 4,163,964

[45] Aug. 7, 1979

[54] PNEUMATIC OR HYDRAULIC PRESSURE SENSORS WITH SEVERAL THRESHOLDS OF RESPONSE

[75] Inventor: Giangrazio De Filippis, Naples, Italy

[73] Assignee: Texas Instruments Incorporated, Dallas, Tex.

[21] Appl. No.: 879,317

[22] Filed: Feb. 21, 1978

[51] Int. Cl.[2] ..... H01H 35/34

[52] U.S. Cl. ..... 338/215; 200/83 P; 200/81.4; 200/83 WM

[58] Field of Search ..... 200/81.4, 81 R, 83 R, 200/83 WM, 83 B, 83 P, 83 A, 159 B, 243, 275, 280, 67 DB, 73, 76; 338/215; 340/365 A, 626

[56] References Cited

U.S. PATENT DOCUMENTS

| | | | |
|---|---|---|---|
| 2,302,923 | 11/1942 | Zimarik | 200/83 WM |
| 3,177,313 | 4/1965 | Klimak | 200/83 P |
| 3,240,895 | 3/1966 | Horowitz | 200/83 P |
| 3,553,402 | 1/1971 | Hire | 200/83 P |
| 3,786,210 | 1/1974 | Byam | 338/215 |
| 3,890,477 | 6/1975 | Saunders | 200/83 P |
| 3,973,091 | 8/1976 | Kaminski | 200/159 B |
| 3,984,650 | 10/1976 | Budlane | 200/83 P |

*Primary Examiner*—Gerald P. Tolin

*Attorney, Agent, or Firm*—John A. Haug; James P. McAndrews

[57] ABSTRACT

The present invention relates to an improvement in pneumatic or hydraulic pressure sensors with several thresholds of response.

There often is a need for pressure sensors with several thresholds of response to predetermined pressure values. One such case exists with washing machines wherein loads at predetermined levels are required. The pressure sensor must therefore signal on the basis of the hydrostatic pressure the level of leading of the washing tub for the closing of, for example, an electric valve.

According to the present invention, the pressure sensor provides for a "lung" comprising an elastic membrane exposed to pressure, which acts on an element that operates a group of electromechanical switching elements, each of which is sensitive to a preestablished actuating force corresponding in turn to a given response pressure of the pressure sensor.

4 Claims, 7 Drawing Figures

PNEUMATIC OR HYDRAULIC PRESSURE SENSORS WITH SEVERAL THRESHOLDS OF RESPONSE

The present invention will be described in the following with reference to preferred embodiments of the invention, given for purposes of illustration only, as illustrated in the attached drawings, wherein.

FIGS. *6a, 6b* show the respective states of the contact elements when actuated and when not actuated respectively.

Figure 1:
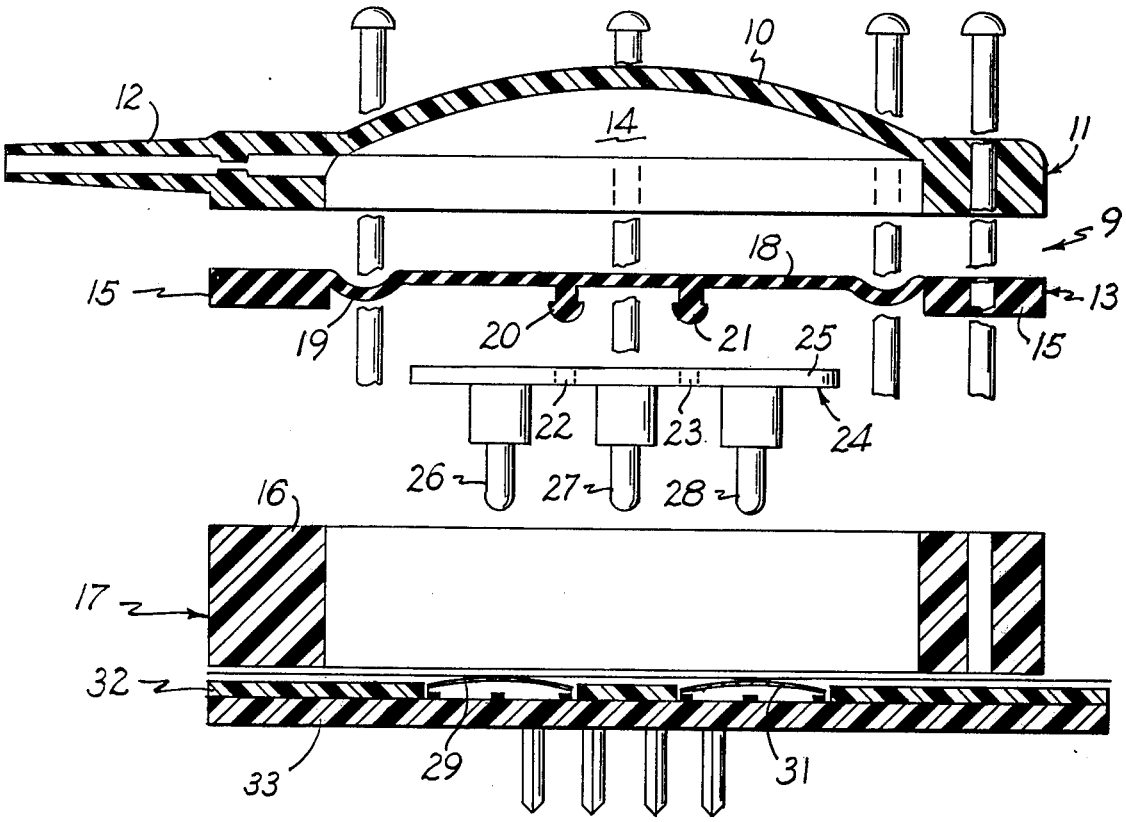
FIG. 1 shows an exploded view partly in cross section along a principal axis of a preferred embodiment of the pressure sensor according to the invention.

Referring to the drawings, particularly to FIG. 1, the pressure sensor 9 according to the present invention, in a preferred embodiment thereof, comprises a calotte-shaped housing 10 with a flange 11 for holding elements of the unit together, and a tubular attachment 12 for connecting to a source of fluid under pressure (e.g. the hydrostatic pressure exerted by the water in the washing basket of a washing machine).

The calotte-shaped housing 10 cooperates with the upper part of the membrane of elastomer 13 to form a cavity or lung 14.

The membrane 13 comprises an annular sealing flange 15 which is pressed tightly against the lower edge of flange 11, and the upper edge 16 of case 17.

The membrane 13 has an upper surface 18 exposed to the fluid under pressure, an elastic or pliable molding portion 19, and pins 20, 21 which insert in corresponding holes 22, 23 of the actuating element 24 equipped with a flat disk portion 25 which supports itself on the lower surface of membrane 13.

The actuating element 24 is provided with three finger elements 26, 27, 28 which constitute an isostatic support on the electromechanical switching elements, as will be shown below.

The switching or control elements consist of curved disks 29, 30, 31 of a dish-shape which are adapted to move to an inverted dish-shape in response to pressure applied thereto. The disks are maintained in position by element 32 in known manner, and cooperate with fixed contact elements mounted on base plate 33 to form a switch.

Figure 2:
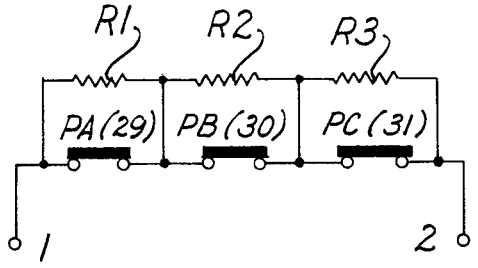
FIG. 2 shows the electrical diagram of the contact arrangement of the sensor of FIG. 1.

FIG. 2 shows the interconnection of the contact elements actuated by the finger elements 26, 27, 28.

Between the terminals 1, 2, the resistances R1, R2, R3 are connected in series, said resistances being individually connected in parallel with the normally closed switches or contact means PA (29), PB (30) and PC (31).

As a result of an increase of pressure on the membrane 13 there first is observed a short circuit across the terminals 1 and 2 through contacts PA, PB and PC. Then as the contacts PA, PB and PC open in response to increasing pressure the value of resistance R1, then R1+R2 are effectively inserted between the terminals 1 and 2, and finally R1+R2+R3.

Figure 3:
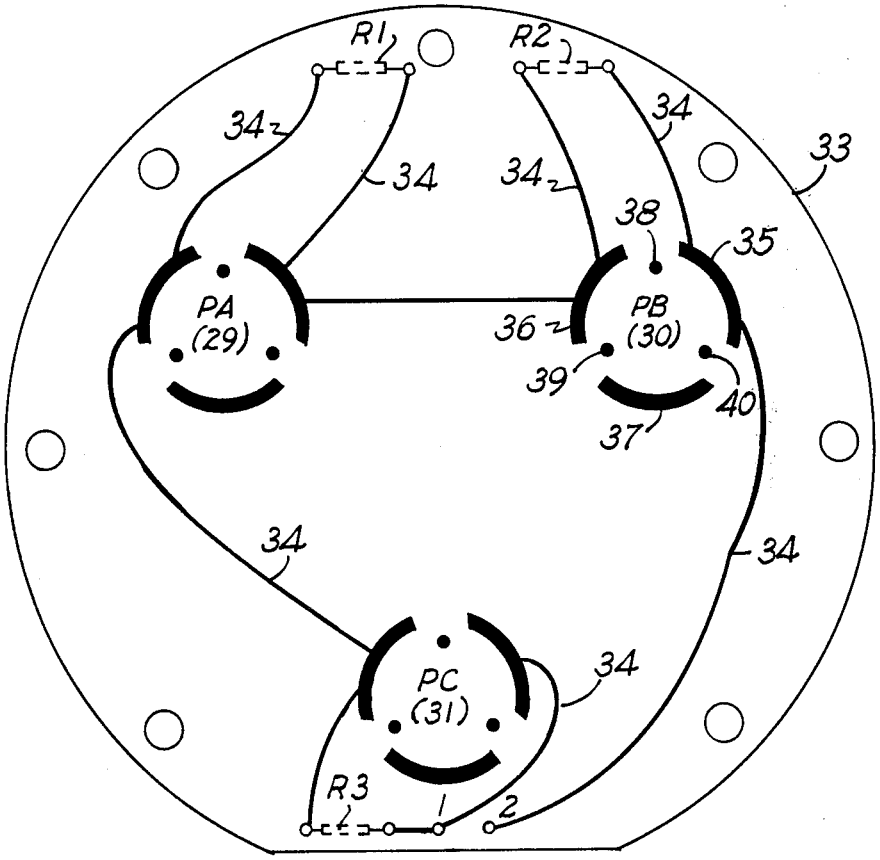
FIG. 3 shows schematically the disposition of a printed circuit with which are connected contact elements operable at predetermined pressures of response.
Figure 4:
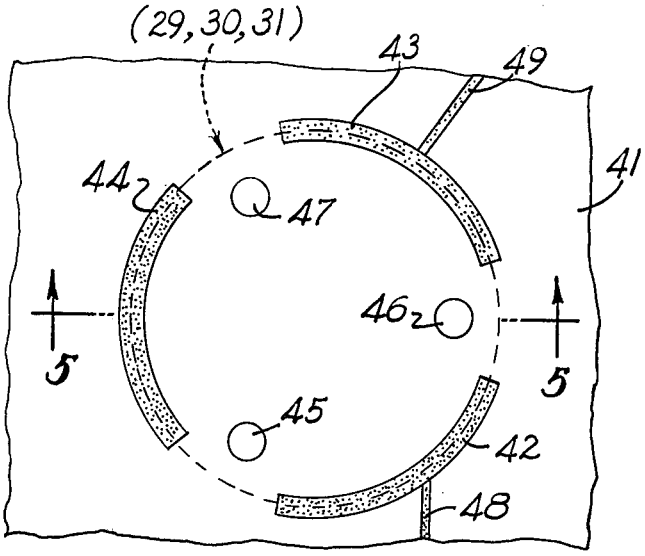
FIG. 4 shows in detail the configuration of the stationary electrical contact elements.
Figure 5:
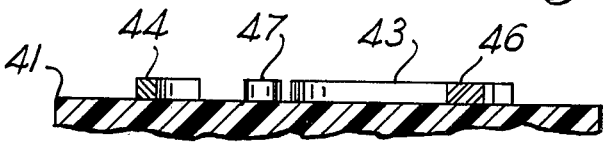
FIG. 5 shows a cross section along line 5—5 of FIG. 4.
Figure 6A:
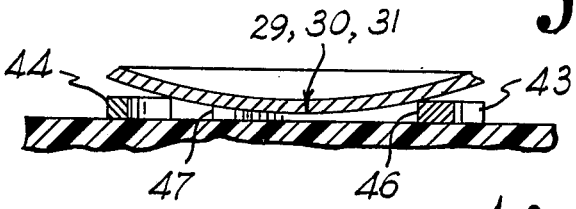
Figure 6B:
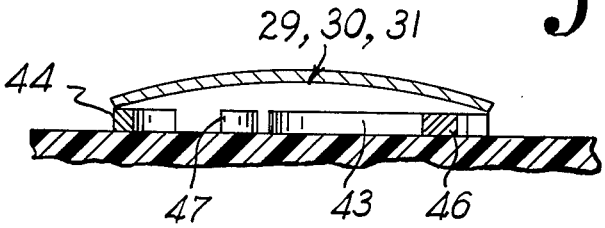

FIG. 3 shows the arrangement of contact elements PA, PB, PC on a printed circuit supported by an insulating plate 33. On the insulating plate 33, the conductive tracks connect the terminals 1, 2 with the resistances R1, R2, R3. These conductive tracks are denoted as a whole by 34, and connect with the conducting zones 35, 36 and 37 which are each provided in form of an arc of a circle of finite depth and between which are disposed the "points" 38, 39, 40 arranged substantially at the apices of an equilateral triangle. The elements 35 through 40 constitute an integral part of contact or switch elements PA, PB, PC, as illustrated with greater clarity in FIGS. 4, 5, *6a* and *6b*.

A typical contact element, such as element PA, consists of a support 41 (33) of insulating material, e.g. as that on which the conventional printed circuits are realized, which carries three zones in form of an arc of a circle 42 (35), 43 (36), 44 (37) preferably equidistant from each other and three "points" 45 (38), 46 (39), 47 (40) substantially angularly equidsitant (120°), inside of the "track" defined by the zones in form of an arc of a circle 42, 43, 44.

When the contact element is not actuated, a curved metal disk 29, 30 or 31 supports itself with its periphery (convex curvature turned upwards) on the zones 42, 43, 44 in form of an arc of a circle (see also FIG. 5), closing the circuit connected to tracks 48 (34), 49 (34). When one of the finger elements 26, 27, 38 in FIG. 1 exerts a sufficient pressure, the contact disk 29, 30 or 31 snaps over, reversing the direction of its curvature (convex curvature turned downwards) and supports itself on the three "points" 45, 46 and 47, opening the circuit between elements 42 and 43 connected to tracks 48 and 49.

The "sensitivity" of the various contact disks to the pressures exerted by the finger elements 26, 27, 28 of FIG. 1 is adjusted, according to requirements, in the place of their manufacture, by varying the material, thickness of the plate constituting the disk and the "height" of the curvature.

All this is known from, for example, the specification of U.S. Pat. No. 3,725,907.

In a second form of realization of the pressure regulator according to the invention, there are used as contact elements actuated by finger elements 26, 27, 28 of FIG. 1 contact elements as specifically described in the above-mentioned U.S. Pat. No. 3,725,907. These contact elements are "normally open" and close themselves selectively at different predetermined pressures exerted by the finger elements 26, 27, 28 which are mechanically connected to the elastic membrane 18.

The just mentioned contact elements are largely known and do not therefore require a detailed description.

The present invention has been described with reference to preferred embodiments of the invention which are given by way of example only and without limiting its scope in any way whatsoever, it being understood that variations and modifications of the same can be made by one skilled in the art without departing from the scope of the present invention.

I claim:

1. A pressure sensing device having a plurality of thresholds of response comprising a membrane movable in response to pressure applied thereto, an actuator movable with the membrane, said actuator having a plurality of actuating portions thereon, electrical contact means, and a plurality of electromechanical control means each of which is movable with snap action to engage or disengage said electrical contact means to perform a selected control function in response to the application of predetermined force thereto and each of which resiliently resists such movement with a predetermined force, said control means normally engaging the respective actuating portions of the actuator so they cooperate in resiliently resisting movement of the membrane and actuator in response to pressure applied to the membrane but so that respective different numbers of said control means are permitted to move to perform their control functions in response to the application of selected different levels of pressure to the membrane.

2. A pressure sensing device having a plurality of thresholds of response comprising a base, a plurality of pairs of electrical contacts mounted in spaced relation on the base, a membrane movable relative to the base in response to pressure applied thereto, an actuator movable with the membrane, said actuator having a plurality of actuating portions thereon, and a plurality of resilient curved disks which are actuable to change direction of curvature with snap action in response to the application of respective different predetermined forces thereto and which are adapted to resiliently resist such change of curvature with said respective different predetermined forces, said disks being arranged for opening and closing connection between respective pairs of said electrical contacts as said disks change said curvature, said disks being normally engaged with said respective actuating portions of the actuator so that the disks cooperate in resiliently resisting movement of the membrane and actuator in response to pressure applied to the membrane but so that respective different numbers of said disks move with snap action to change their curvature in response to the application of selected different levels of pressure to the membrane.

3. A pressure sensing device as set forth in claim 2 wherein said pairs of electrical contacts are disposed in a common plane on said base, said actuator is secured to the membrane for movement therewith, and said actuator has a plurality of actuating fingers having said respective actuating portions thereon exerting isostatic forces on the respective disks.

4. A pressure sensing device as set forth in claim 2 wherein said respective pairs of contacts are connected in series relation in a circuit and said disks are supported relative to said respective pairs of electrical contacts for normally closing connection between the respective pairs of contacts and for opening said connection when said disks are actuated to change their direction of curvature in response to application of pressure to the membrane, said device having selected resistances connected across the respective pairs of contacts for significantly increasing circuit resistance when the respective disks are actuated.

* * * * *